US005575380A

United States Patent [19]

Imai

[11] Patent Number: 5,575,380

[45] Date of Patent: Nov. 19, 1996

[54] ELECTRIC SWITCH HAVING A SEAL DEVICE

[75] Inventor: Kiyoshi Imai, Toyama, Japan

[73] Assignee: Kitano Co., Ltd., Toyama, Japan

[21] Appl. No.: 506,122

[22] Filed: Jul. 24, 1995

[30] Foreign Application Priority Data

Jul. 25, 1994 [JP] Japan ..... 6-010628 U

[51] Int. Cl.[6] ..... H01H 13/06

[52] U.S. Cl. ..... 200/302.2; 200/547; 200/551; 200/517

[58] Field of Search ..... 200/523, 547, 200/551, 302.2, 241, 302.1, 530, 534, 512, 517

[56] References Cited

U.S. PATENT DOCUMENTS 3,154,659 10/1964 Flanagan, Jr. et al. ..... 200/547

4,324,956 4/1982 Sakakino et al. ..... 200/551

4,417,113 11/1983 Saito et al. ..... 200/302.2

5,350,893 9/1994 Yamauchi et al. ..... 204/547

*Primary Examiner*—David J. Walczak

*Attorney, Agent, or Firm*—Dennison, Meserole, Pollack & Scheiner

[57] ABSTRACT

A slide button is slidably mounted on a case, and a push button having a cylindrical shaft portion is provided in a hole of the case so as to be moved in a direction perpendicular to the sliding direction of the slide button. The push button is pushed by sliding the slide button so as to close a switch. An O-ring is disposed between the cylindrical shaft portion of the push button and an inside wall of the hole of the case.

3 Claims, 4 Drawing Sheets

ELECTRIC SWITCH HAVING A SEAL DEVICE

BACKGROUND OF THE INVENTION

The present invention relates to a an electric switch having a seal device for preventing water from entering an electric device such as an electric toothbrush.

There is provided an electric switch having a manually slidable button for operating a movable contact. In such a switch, it is difficult to provide a seal device for the slidable button.

SUMMARY OF THE INVENTION

An object of the present invention is to provide an electric switch having a seal device which is simplified in construction and ensured in sealing effect.

To this end, the present invention is characterized in that a slide button is slidably mounted on a support, a push button having a cylindrical shaft portion is provided in a hole of the support so as to be moved in a direction perpendicular to the sliding direction of the slide button. Projections are formed on the slide button and push button for moving the push button by sliding the slide button, and an O-ring is disposed between the cylindrical shaft portion of the push button and an inside wall of the hole of the support.

A movable contact is provided to engage with the cylindrical portion of the push button, and a fixed contact is provided to be contacted with the movable contact so as to close a circuit.

These and other objects and features of the present invention will become more apparent from the following detailed description! with reference to the accompanying drawings.

DETAILED DESCRIPTION OF THE PREFERRED EMBODIMENT

Figure 1:
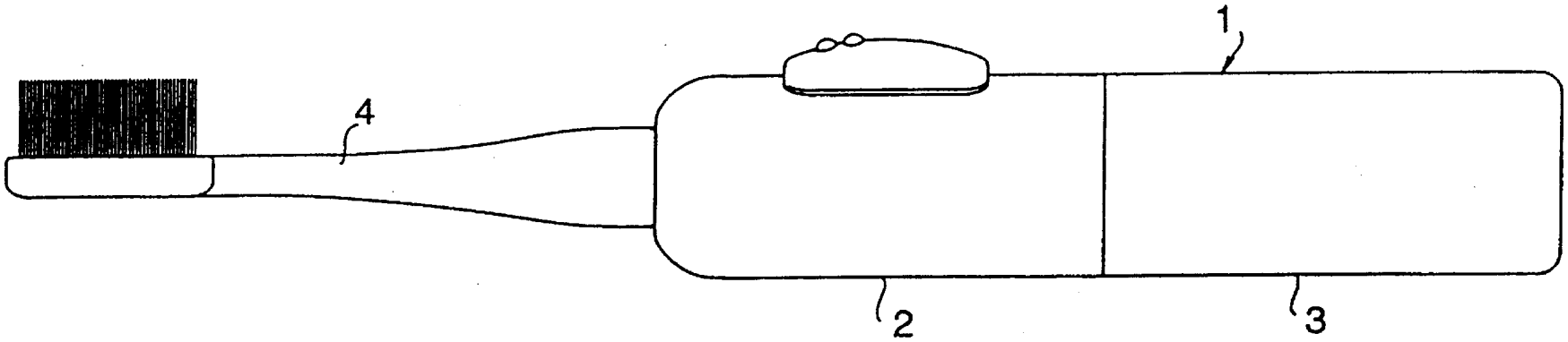
FIG. 1 is a side view showing an electric toothbrush to which the present invention is applied.

Referring to FIG. 1, the electric toothbrush to which the present invention is applied comprises a cylindrical case body 1 comprised of a front case 2 and a rear case 3 as a handle, and a brush 4 attached to the front case 2.

Figure 2:
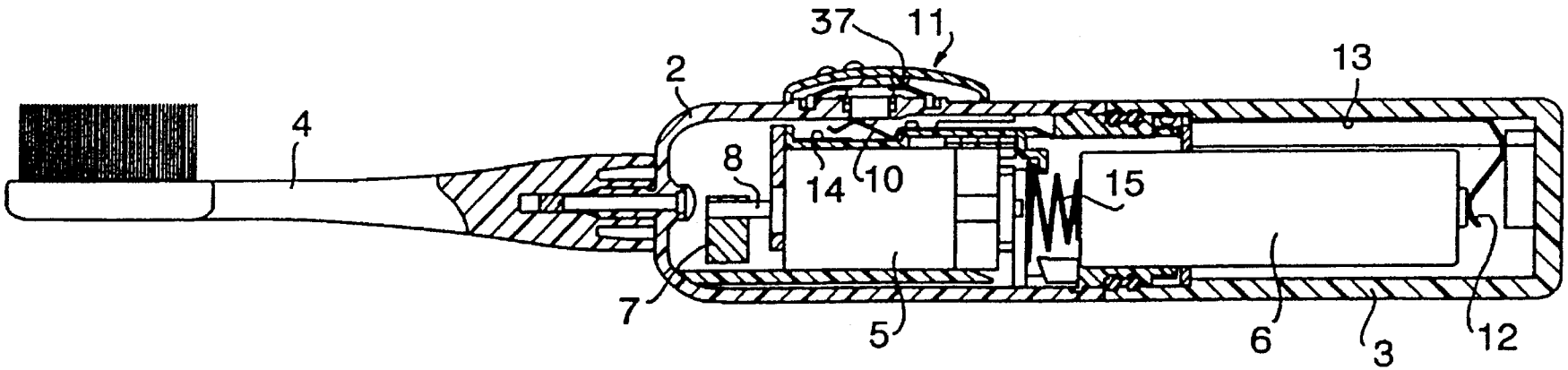
FIG. 2 is a sectional view of the electric toothbrush of FIG. 1.

As shown in FIG. 2, a motor 5 is mounted in the front case 2, and a battery 6 is housed in the rear case 3. An eccentric weight 7 is secured to a rotating shaft 8 of the motor 5. A positive terminal of the battery 6 is connected to a movable contact 10 of an electric switch 11 through a spring plate 12 and a lead 13. A fixed contact 14 of the switch 11 is connected to a positive terminal of the motor 5. A negative terminal of the motor 5 is connected to a negative terminal of the battery 6 through a spring contact 15.

Figure 3:
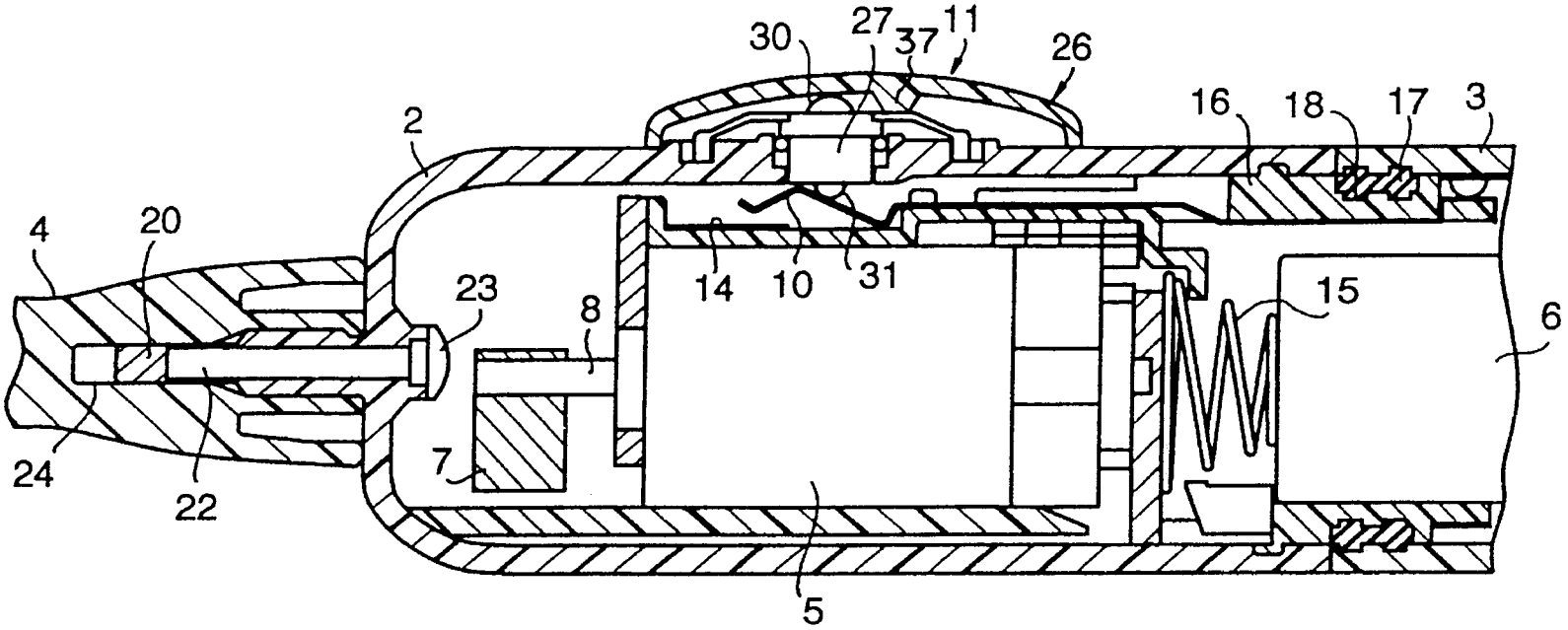
FIG. 3 is an enlarged sectional view of a main part of the electric toothbrush.
Figure 4:
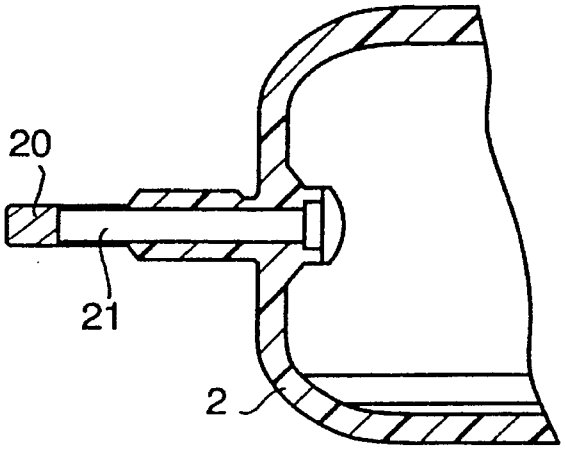
FIG. 4 is an enlarged sectional view of a front part of a case body.

Referring to FIG. 3, a connecting cylinder 16 is secured to the inside wall of the front case 2. The outer diameter of the connecting cylinder 16 is slightly smaller than the inner diameter of the rear case 3 so that the rear case can be engaged on the connecting cylinder. An O-ring 17 is engaged in an annular groove 18 formed on the outside periphery of the connecting cylinder 16. The rear case 3 is connected to the front case 2 by engaging the front portion thereof on the connecting cylinder 16, engaged with the O-ring 17 to form a watertight sealing between the front and rear cases.

On the other hand, a connecting shaft 20 is forwardly projected from the front end of the front case 2. In the connecting shaft 20, an axial hole 21 is formed. A metallic pin 22 is engaged in the hole 21 and secured thereto with an adhesive 23.

The brush 4 has an axial hole 24 corresponding to the connecting shaft 20. Thus, the brush 4 is attached to the front case 2 by engaging the hole 24 with the connecting shaft 20.

Figure 5:
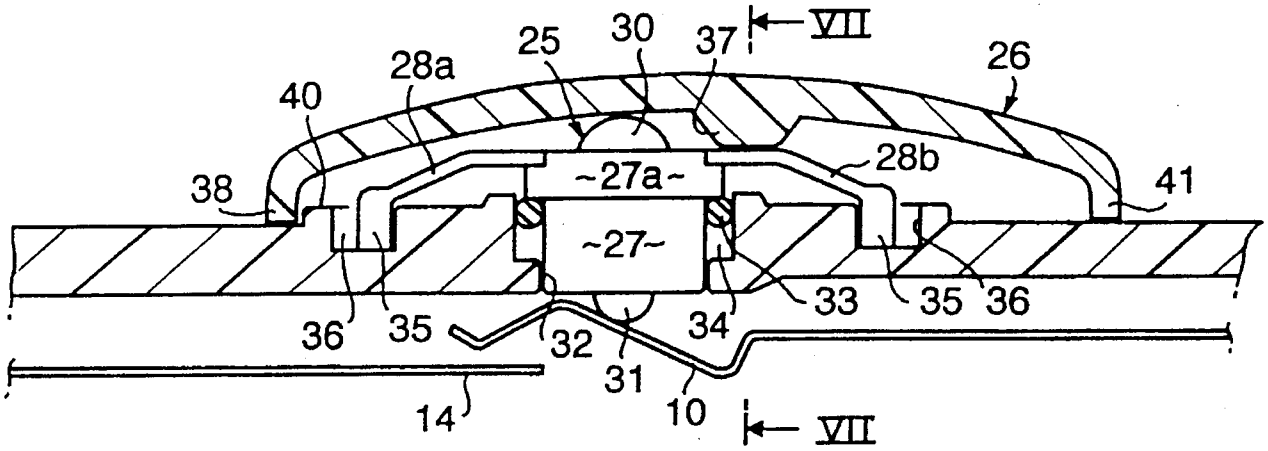
FIGS. 5 and 6 are sectional views showing an electric switch of the present invention.

Referring to FIG. 5, the switch 11 according to the present invention comprises a push button 25 and a slide button 26. The push button 25 is made of plastic and has a cylindrical shaft portion 27, elastic stays 28*a* and 28*b* projecting from the shaft portion 27 in the forward and rearward directions, an upper projection 30 formed on the upper surface of the shaft portion 27, and a lower projection 31 formed on the underside surface of the shaft portion. The shaft portion 27 is slidably engaged in a lateral hole 32 formed in the front case 2. The shaft portion 27 has a flange 27*a*. An O-ring 33 is mounted in an annular space 34 formed between the inside wall of the hole 32, the flange 27*a*, and the shaft portion 27 so that a sealing means is provided for watertightly holding the shaft portion 27. A pair of elastic stays 28*a*, 28*b* are formed integral with the cylindrical shaft portion 27. Formed on the end of each of the elastic stays 28*a* and 28*b* is a leg 35 which is slidably engaged in a opening 36 formed in the front case 2. The lower projection 31 contacts with the movable contact 10 so as to make the switch 11.

Figure 7:
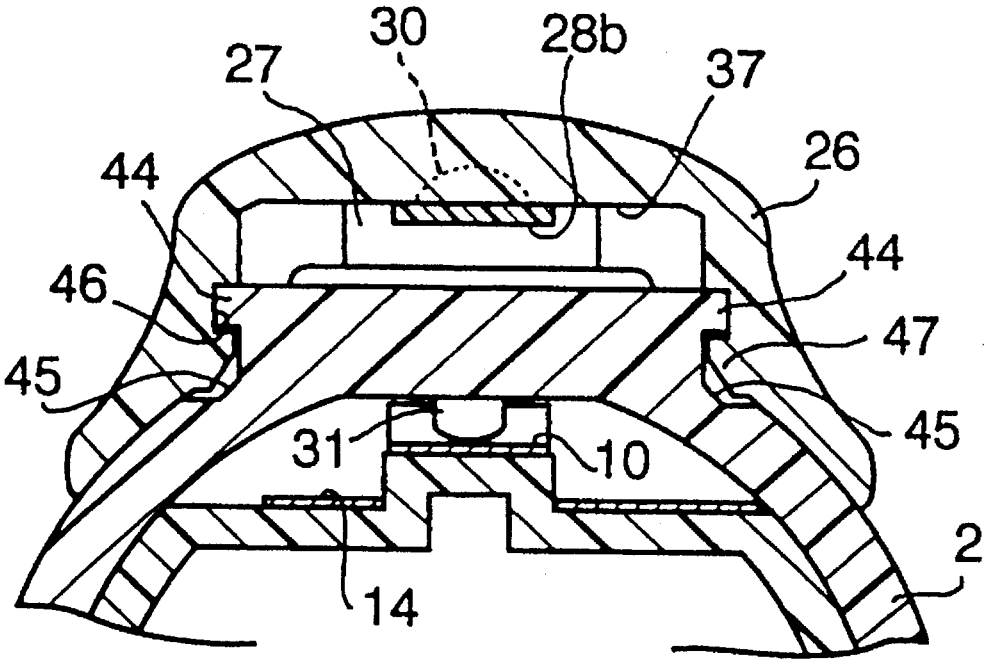
FIG. 7 is a sectiional view taken along a line VII—VII of FIG. 5.

As shown in FIG. 7, a pair of parallel guide rails 44 and guide grooves 45 are formed on the front case 2, longitudinally extending at opposite sides of the push button 25.

The slide buttons 26 has a pair of grooves 46 slidably engaged with the guide rails 44 respectively, and a pair of projections 47 slidably engaged with the grooves 45, respectively. Thus, the slide button 26 is mounted for longitudinal movement on the front case 2. On the underside of the slide button 26, a pushing projection 37 is formed, corresponding to the upper projection 30. In the unoperated state shown in FIG. 5, a front leg 38 abuts on a front stopper 40.

Figure 6:
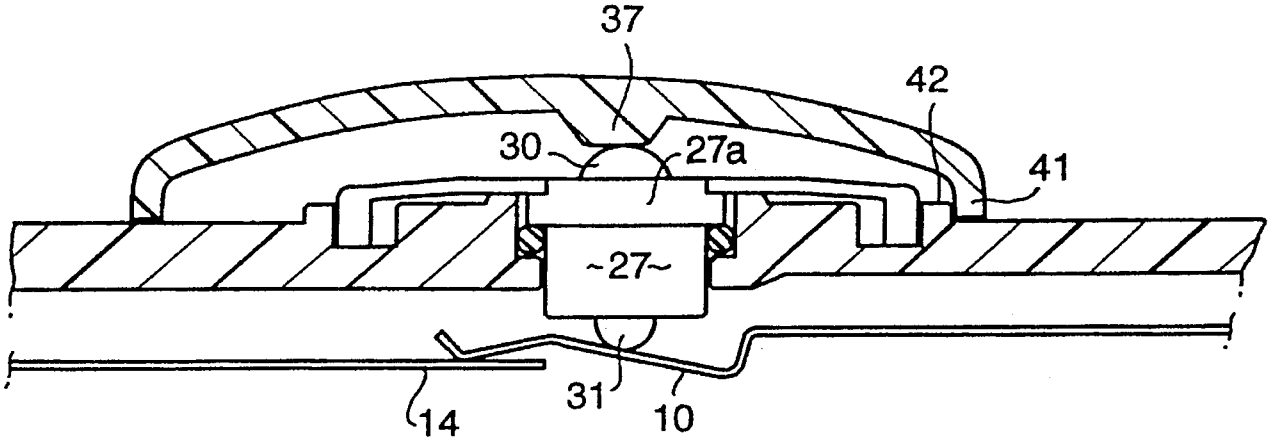

When the slide button 26 is forwardly slid as shown in FIG. 6, the pushing projection 37 engages with the upper projection 30 to push it, so that the entire push button 25 is moved downward. Thus, the lower projection 31 pushes the movable contact 10 so that the movable contact 10 contacts with the fixed contact 14 to close the switch 11. At that time, elastic stays 28*a* and 28*b* expand, and hence the legs 35 move in the holes 36 respectively, and a rear leg 41 of the slide button 26 abuts on a rear stopper 42. By the closing of the switch, the motor 5 operates to rotate the eccentric weight 7. Consequently, the front case 2 is vibrated. The vibration of the front case is transmitted to the brush 4 through the connecting shaft 20.

When the slide button 26 is rearwardly moved from the position of FIG. 6 to the position of FIG. 5, the pushing projection 37 moves away from the projection 30. Consequently, the push button 25 is moved upward by the elastic forces of the stays 28*a* and 28*b*. Thus, the movable contact 10 is disengaged from the fixed contact 14. Consequently, the switch is opened and the operation of the toothbrush stops.

In accordance with the present invention, the sealing device comprises an O-ring. Therefore, the sealing effect is ensured, and the construction is simplified.

While the invention has been described in conjunction with preferred specific embodiment thereof, it will be understood that this description is intended to illustrate and not limit the scope of the invention, which is defined by the following claims.

What is claimed is:

1. An electric switch mounted on a support comprising:

a slide button having a pushing projection formed on an underside thereof, and slidably mounted on top of the support, a push button made of plastic, and having a cylindrical shaft portion, a flange formed on a top of the cylindrical shaft portion, a pair of elastic stays formed integral with the flange, a first projection formed on an upper surface of the flange, and a second projection formed on an underside of the shaft portion, the cylindrical shaft portion and the flange being inserted in a hole formed in the support so as to be movable in a pushing direction perpendicular to a sliding direction of the slide button;

an O-ring disposed in an annular space formed between the cylindrical shaft portion of the push button, an inside wall of the hole in the support, and an underside of the flange so as to seal the hole;

a movable contact engaged with the second projection, and having an elasticity to return itself to an original position;

a fixed contact to be contacted with the movable contact so as to close a circuit;

each of the elastic stays having a downward inclined portion and a leg formed on an end of each elastic stay;

each leg being slidably engaged in an opening formed in the support; and the elastic stays having an elasticity sufficient to move the push button in a direction opposite to the pushing direction of the push button wherein upon sliding of said slide button, said pushing projection contacts said first projection and thereby depresses said push button in said pushing direction to thereby depresses said push button contact into electrical contact with said fixed contact.

2. An electric switch mounted on a support, said support having a lateral hole and a pair of openings comprising:

a slide button having a pushing projection formed on an underside thereof, and slidably mounted on top of the support;

a push button made of plastic, and having a cylindrical shaft portion, a flange formed on a top of the cylindrical shaft portion, a pair of elastic stays formed integral with the flange, a first projection formed on an upper surface of the flange, and a second projection formed on an underside of the shaft portion, the cylindrical shaft portion and the flange being inserted in the lateral hole of the support so as to be movable in a pushing direction perpendicular to a sliding direction of the slide button;

an O-ring disposed in an annular space formed between the inside wall of said lateral hole, an underside of the flange and the cylindrical shaft portion of the push button so as to provide a seal;

a movable contact engaged with the second projection, and having an elasticity to return itself to an original position;

a fixed contact to be contacted with the movable contact so as to close a circuit;

each of the elastic stays having a downward inclined portion and a leg formed on an end of each elastic stay;

each leg being slidably engaged in one of said openings formed in the support; and the elastic stays having an elasticity sufficient to move the push button in a direction opposite to the pushing direction of the push button wherein upon sliding of said slide button, said pushing projection contacts said first projection and thereby depresses said push button in said pushing direction to thereby move said movable contact into electrical contact with said fixed contact.

3. The electric switch according to claim 2, wherein the support is the case of an electric toothbrush.

* * * * *

UNITED STATES PATENT AND TRADEMARK OFFICE

CERTIFICATE OF CORRECTION

PATENT NO. : 5,575,380

DATED : November 19, 1996

INVENTOR(S) : KIYOSHI IMAI

It is certified that error appears in the above-indentified patent and that said Letters Patent is hereby corrected as shown below:

Title page:

item [73] Assignee:

Kitano Co., Ltd., Toyama, Japan
Japan CBM Corporation, Tokyo, Japan

Signed and Sealed this

Sixteenth Day of September, 1997

*Attest:*

*Attesting Officer*

BRUCE LEHMAN

*Commissioner of Patents and Trademarks*